US007856761B2

(12) United States Patent
Heselden

(10) Patent No.: US 7,856,761 B2
(45) Date of Patent: Dec. 28, 2010

(54) PROTECTIVE SHELTER

(75) Inventor: James Heselden, Leeds (GB)

(73) Assignee: Hesco Bastion Limited, Leeds, Yorkshire (GB)

( * ) Notice: Subject to any disclaimer, the term of this patent is extended or adjusted under 35 U.S.C. 154(b) by 172 days.

(21) Appl. No.: 12/118,403

(22) Filed: May 9, 2008

(65) Prior Publication Data

US 2008/0283106 A1 Nov. 20, 2008

(30) Foreign Application Priority Data

May 15, 2007 (GB) ..... 0709319.8
May 18, 2007 (GB) ..... 0709569.8
Jan. 15, 2008 (GB) ..... 0800652.0
Feb. 28, 2008 (GB) ..... 0803661.8

(51) Int. Cl.
*E04D 3/34* (2006.01)
*E04H 15/36* (2006.01)
*E04B 7/04* (2006.01)

(52) U.S. Cl. ..... 52/22; 52/86; 52/169.1; 52/339; 52/633; 135/122; 135/124; 135/906; 135/87

(58) Field of Classification Search ..... 52/169.1, 52/169.14, 338–340, 365, 404.1, 408, 632–634, 52/690–692, 506.06–506.07, 3–4, 22–23, 52/86–88; 135/87, 124, 905–906, 121–122
See application file for complete search history.

(56) References Cited

U.S. PATENT DOCUMENTS 948,824 A * 2/1910 Patterson ..... 52/330
1,821,355 A * 9/1931 Murray ..... 52/336
2,793,720 A * 5/1957 Hawes ..... 52/640
2,985,264 A * 5/1961 Leonard, Jr. ..... 52/640
3,008,435 A * 11/1961 Dupuy ..... 109/1 S
3,206,896 A 9/1965 Hayes
3,820,294 A 6/1974 Parker
3,940,892 A * 3/1976 Lindbergh ..... 52/86

(Continued)

FOREIGN PATENT DOCUMENTS

EP 0 466 726 11/1995

(Continued)

OTHER PUBLICATIONS

United Kingdom Search Report for patentability in relation to a Shelter, dated Jan. 30, 2008.

*Primary Examiner*—Winnie Yip
(74) *Attorney, Agent, or Firm*—Ping Wang; Andrews Kurth, LLP

(57) ABSTRACT

A protective shelter that can be used to provide protection within a war zone, and which can be readily assembled in a quick, secure and reliable manner. The shelter is formed of opposite outer walls and a roof structure extending therebetween, wherein the roof structure comprises a plurality of tray members supported by beam supports and in which the plurality of tray members is arranged to receive earth, sand or aggregate material so as to provide a first layer of protection via the roof structure. The tray members can be supported by beams serving to define a shallow arch across the shelter such that the internal height of the shelter centrally, and away from the opposite walls, which is greater than the height of the said walls.

29 Claims, 10 Drawing Sheets

U.S. PATENT DOCUMENTS 4,283,888 A * 8/1981 Cros ..... 52/3
4,590,721 A * 5/1986 Berg et al. ..... 52/169.1
4,592,184 A * 6/1986 Person et al. ..... 52/334
5,159,790 A * 11/1992 Harding ..... 52/86
5,740,643 A * 4/1998 Huntley ..... 52/265
6,076,319 A * 6/2000 Hendershot et al. ..... 52/271
7,073,306 B1 * 7/2006 Hagaman ..... 52/745.09
7,353,642 B1 * 4/2008 Henriquez ..... 52/741.41

FOREIGN PATENT DOCUMENTS

WO 86/02688 A1 5/1986

* cited by examiner

PROTECTIVE SHELTER

FIELD

The present invention relates to a protective shelter and, in particular, to such a shelter that can provide protection within a war zone and which can be readily assembled in a quick, secure and reliable manner.

BACKGROUND

While a variety of requirements arise for temporary, or at least quickly-built shelters, there is generally a compromise between the level of protection offered by the shelter and the speed, reliability and ease with which such a structure can be built.

Also, the degree of protection required by the shelter can change over time and known protective shelters, while perhaps providing an appropriate initial level of protection, may not be suited to a scenario in which a lesser, or greater, degree of protection is required.

The invention seeks to provide for a protective shelter having advantages over known such shelters.

SUMMARY

A protective shelter is disclosed. In one aspect, the protective shelter comprises opposite outer supports and a roof structure extending between the opposite outer supports. The roof structure comprises a plurality of tray members arranged to receive earth, sand or aggregate material defining an inner skin to provide a first level of protection in the roof structure. The tray members are supported by beams.

In one embodiment, the beams are arranged to define a shallow arch across the shelter such that the internal height of the shelter centrally, and away from the opposite outer supports, is greater than the height of the opposite outer supports.

In a preferred embodiment, the beams are transverse beams extending between the opposite outer supports.

In another embodiment, the roof structure further comprises a screen that is spaced above and extending over the tray members to provide a second level of protection in the roof structure.

In another embodiment, the roof structure further comprises roof trusses arranged to support the screen.

In another embodiment, the opposite outer supports are walls or gabions.

In a preferred embodiment, the gabion is a cage structure adapted to be filled with a filling material in order to provide a structural block. In an embodiment, said cage structure comprises a wall or walls at least partially defined by open work mesh, and a lining material lying to the inside of said open work mesh to enable the cage to be filled with a particulate material which would pass through the open work mesh were it not for the presence of the lining material.

In another aspect, the protective shelter comprises opposite outer supports; and a roof structure extending between said opposite outer supports; wherein said roof structure comprises a plurality of tray members arranged to receive earth, sand or aggregate material defining an inner skin to provide a first level of protection in said roof structure, wherein said tray members are supported by beams, wherein said beams are arranged to define a shallow arch across the shelter such that the internal height of the shelter centrally, and away from said opposite outer supports, is greater than the height of said opposite outer supports.

In another aspect, the protective shelter comprises opposite outer supports, a roof structure extending between the opposite outer supports, and a stand-off wall located outside a door of the shelter. The roof structure comprises a plurality of tray members arranged to receive earth, sand or aggregate material defining an inner skin to provide a first level of protection in the roof structure and a protective screen, spaced above and extending over the tray members, to provide a second level of protection in the roof structure.

In one embodiment, the protective shelter further comprises a porch extending from the roof structure to the stand-off wall.

BRIEF DESCRIPTION OF THE DRAWINGS

The invention is described further hereinafter, by way of example only, with reference to the accompanying drawings in which.

DETAILED DESCRIPTION

Figure 1:
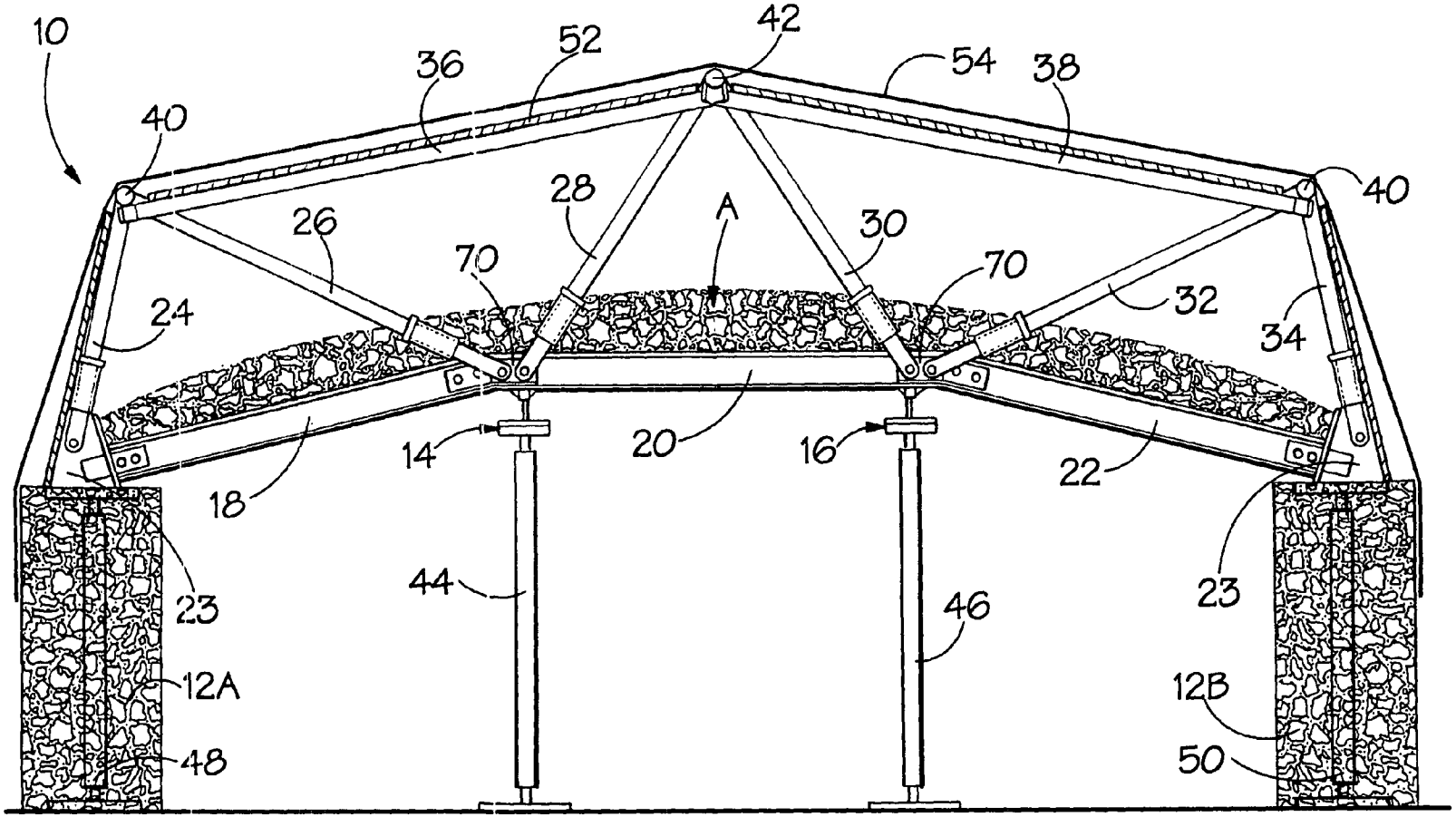
FIG. 1 is a sectional view of a protective shelter according to an embodiment of the present invention.

As will be appreciated from the following description, examples of a shelter embodying the present invention can be quickly and, importantly, reliably constructed in a manner requiring a minimum number of personnel and, critically, in a manner such that each separate component of the structure can be removed and lifted single-handedly.

Also, all separate components can advantageously be of a size such that they are readily transportable, in flat-packed unassembled form on a pallet, such as a pallet of dimensions 2 meters×2.2 meters.

As will be appreciated, the invention provides for a protective shelter offering opposite outer supports and a roof structure extending between the supports, wherein the roof structure comprises a plurality of tray members arranged to receive earth, sand or aggregate material defining an inner skin to provide a first level of protection in the roof structure, and the tray members are arranged to be supported by beams, wherein the beams are arranged to define a shallow arch across the shelter such that the internal height of the shelter centrally, and away from the opposite supports, is greater than the height of said supports.

In order to assist the quick and reliable formation of such a shallow arch structure, the supporting beam members advantageously comprise beams of identical shape and configuration and the end faces of which are angled, or bevelled, in respect to a plane perpendicular to the longitudinal extent of each of the beams. The angle to the said plane is advantageously 7.5°.

As a further advantage, the ends of the transverse beams that are arranged to be supported by the side walls are arranged to be received by anchor assemblies. Preferably, a vertical member of the transverse beams includes sections to accommodate flitch plates, for supportively connecting the beams. Preferably still, the sections are controlled tolerance channels in the beams. Advantageously, securing the transverse beams with the flitch plates in this manner creates a strong continuous roof beam.

The anchor assemblies advantageously serve to space the transverse beams along the length of the shelter and are arranged such that each transverse beam is effectively connected to, in a secure manner, and sandwiched between, adjacent anchor assembly units. Alternatively, it can be considered that each anchor assembly unit is effectively securely connected to, and sandwiched between, adjacent transverse beams.

In any case, the anchor assembly units, through their secure engagement to the transverse roof beams, provide for a rigid footing/support structure that extends along the length of the upper surface of the walls of the shelter and thereby combine to effectively define a lintel beam extending along the length of the wall. Such rigid supporting structure provided by the interconnected anchor assembly units serves to define the aforementioned lintel beam in a manner such that, should the outer wall suffer damage, or the integrity thereof be in any way compromised, the rigidity and stability of the overall roof structure can remain intact advantageously serving to retain the roof structure in place in spite of any such damage to the wall(s).

The structure of the invention can advantageously include a second laterally extending layer, spaced from the tray members and arranged so as to define a pre-detonation screen.

The pre-detonation screen is advantageously spaced from the initial layer formed by the tray members and the soil, sand, aggregate layer by a distance in the order of 1 meter.

Preferably, the tray members comprise a series of interconnected identical tray members having mutually connectable engagement formations at opposite ends thereof.

As a further feature, the portions of the roof structure provided above the earth, sand or aggregate layer can advantageously be formed from the interconnected metal poles, for example, such as scaffold poles.

Such poles are arranged to provide roof trusses and rafter poles, within the overall structure of the roof. As one example, the pre-detonation screen can comprise plywood panels having a thickness of 19 mm.

As should be appreciated from the above, and from the description below, the invention is particularly advantageous insofar as the roof structure can be readily formed on gabion units which are arranged to form the opposite walls of the shelter.

The wall structures can be formed from structural blocks such as those that are the subject matter of European Patent 0466726.

The overall protective shelter can then be quickly and reliably constructed as required, and in a manner responsive to the level of danger faced, and the level of protection required.

For example, once the gabions are in place to form the walls of the shelter, the roof structure can be readily, reliably formed, requiring a minimal number of personnel and, through use of the component parts described herein, in a structurally rigid and reliable manner so as to first provide a basic level of blast protection by way of the transverse beams and interlying series connected trays, as described further herein, and the layer of earth, sand or other aggregate provided thereon.

The level of protection can be further enhanced by inclusion of a pre-detonation screen which, again, can be constructed in a fast, efficient and reliable manner as and when required.

An adaptable degree of protection can then advantageously be provided by a shelter embodying the present invention.

Turning first to FIG. 1, there is provided a sectional view of a protective shelter (10) according to an embodiment of the present invention.

The shelter (10) is provided with opposite side walls (12*a*), (12*b*) formed of aligned gabions upon which a roof structure according to the invention is supported.

The roof structure in the illustrated embodiment comprises a pair of parallel longitudinal beams (14), (16) extending along the length of the shelter (10) and parallel to the opposite walls (12*a*), (12*b*).

Supported upon the longitudinal beams (14), (16) and extending in a manner perpendicular thereto across the width of the shelter (10) so as to be supported in part upon the upper surface of the opposite walls (12*a*), (12*b*) is a transverse beam structure comprising three elongate series connected transverse beams (18), (20), (22).

Each of the transverse beams (18), (22) that is supported on the upper surface of each of the opposite walls (12*a*), (12*b*) is arranged to engage with a roof beam anchor assembly unit (23). In addition to providing secure support for the transverse roof beam structure (18), (20), (22) on the opposite walls (12*a*), (12*b*), such roof beam anchor assembly units (23) are also arranged to be interconnected by way of their connection to their respective transverse roof beams (18), (22) so as to provide for a rigid and secure lintel beam structure extending along the lengths of the walls (12*a*), (12*b*). The shape and configuration and structural detail of each of the roof beam anchor assembly units (23) is illustrated in further detail later with reference to FIGS. 9 and 10.

As can be seen from FIG. 1, each transverse beam (18), (20), (22) is positioned at a slight angle to its neighbour so that when conjoined in series as illustrated in FIG. 1, the transverse beam structure (18), (20), (22) forms a shallow arch extending between the opposite side walls (12*a*), (12*b*).

As will be appreciated from the further discussion of FIG. 7 below, each end face of each transverse beam (18), (20), (22) is provided at a shallow angle, and preferably in the order of 7.5°, to a plane perpendicular to the longitudinal extent of the beam such that, when the respective end faces of each series connected transverse beams (18), (20), (22) abut, the shallow arch is readily formed in an appropriate configuration.

The provision of such a shallow arch advantageously provides for a suitable internal height to the protective shelter, whilst advantageously limiting the height to which the supporting opposite walls (12*a*), (12*b*) have to be provided, and thus also the thickness to which such walls (12*a*), (12*b*) have to be provided.

Through such careful design of the structural components of the roof as illustrated in FIG. 1, the roof structure can be provided in a manner such that each single component can be lifted and manipulated single handedly.

Extending upwardly from the transverse beam structure (18), (20), (22), and from locations approximate the ends of the transverse beams (18), (20), (22) are respective pairs of roof trusses (24), (26); (28), (30), (32), (34).

In the illustrated example, the roof trusses are in the form of metal poles and the ends of each respective pair (24), (26); (28), (30); (32), (34) of roof truss poles remote from the transverse beam structure (18), (20), (22) are connected together either directly or by way of further features of the roof structure to be described below.

The respective pairs of roof trusses (24), (26); (28), (30); (32), (34) serve to support rafter poles (36), (38) which extend in a transverse manner across the upper part of the roof structure of the shelter (10) in the manner illustrated.

The outer ends of the rafter poles (36), (38) are connected to eaves poles (40) which extend longitudinally along the roof structure of the shelter (10) and in a direction parallel to the opposite walls (12*a*), (12*b*).

The inner ends of the rafter poles (36), (38) are connected to a central ridge pole (42) which, in the illustrated example, can comprise a scaffold tube, and which serves to define the upper extent of the roof structure of the shelter (10).

As with the eaves poles (40), the ridge pole (42) extends longitudinally along the length of the shelter (10) and in a manner parallel to the opposite outer walls (12*a*), (12*b*) and the longitudinal beams (14), (16).

As a further feature, adjustable internal props (44), (46) are included so as to provide internal support to the longitudinal beams (14), (16).

Although the illustrated embodiment is designed around an outer wall of gabions, if insufficient support might be provided thereby, adjustable props (48), (50) can likewise be provided within the wall structure so to provide appropriate support to the roof structure as illustrated.

Figure 1A:
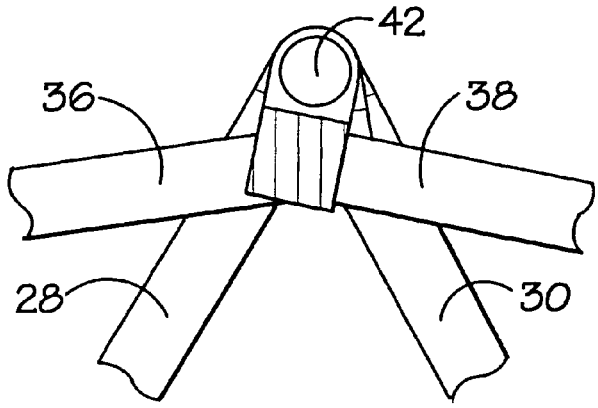
FIG. 1*a* is a side elevational view showing additional detail of the connecting structure roof trusses and supports of the protective shelter of FIG. 1.
Figure 1B:
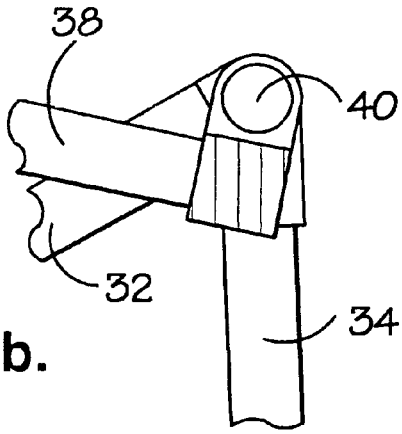
FIG. 1*b* is a side elevational view showing yet additional detail of the roof trusses and supports of the protective shelter of FIG. 1.

As will be described in further detail below, the rafter poles (36), (38) and the outermost roof trusses (24), (34) serve to provide support for a pre-detonation screen (52) which, in the illustrated embodiment, can be formed of plywood panels. FIG. 1*a* illustrates an elevational view of the intersection of the ridge pole (42), rafter poles (36), (38) and roof trusses (28), (30) in more detail. Likewise, FIG. 1*b* illustrates an elevational view of the intersection of the eves pole (40), rafter pole (38) and roof trusses (32), (34) in more detail.

To complete the structure, and provide some weatherproofing thereto, an outer roof fabric cover (54) is included which can be anchored to the outer surfaces of the opposite walls (12*a*), (12*b*).

As will be appreciated from FIG. 1, the roof structure of the protective shelter (10) of the illustrated embodiment effectively forms a two-skin structure in which a pre-detonation screen is provided by the plywood panels as a first outer skin, and a second, but somewhat more protective and rigid, inner skin is provided by laterally extending tray sections (see, for example, FIG. 8 below) which combine to form a surface in the planes of each of the transverse beams (18), (20), (22) and upon which earth, sand or other aggregate is located such as illustrated by arrow A in FIG. 1.

Insofar as the pre-detonation screen provided by the plywood panels (52) is of an appropriate thickness to achieve detonation of, for example, incoming mortar rounds, the product of any such blast is then advantageously absorbed by the earth, sand or aggregate layer (18) located on the trays of the roof structure so as to maintain overall integrity of the inner layer of the roof structure and provide an appropriate level of protection for personnel located within the structure.

Advantageously, the distance between the pre-detonation screen (52) and the earth, sand or aggregate layer (80) is in the order of 1 meter so as to provide for appropriate blast resistance.

Figure 2:
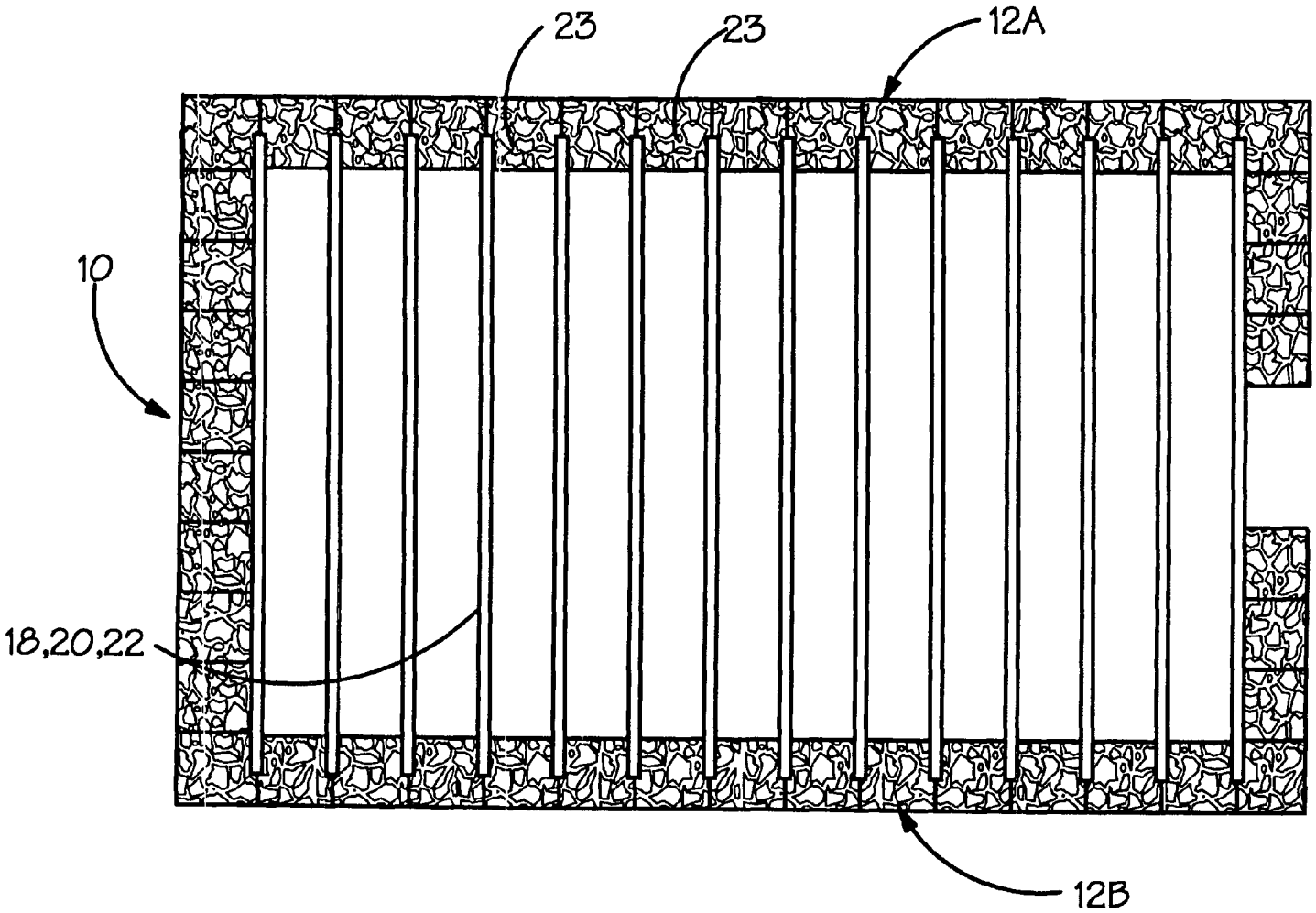
FIG. 2 is a plan view of the protective shelter illustrated in FIG. 1.

Turning now to FIG. 2, there is provided a plan view of the protective shelter of FIG. 1 but illustrating only the transverse beam structure (18), (20), (22) thereof.

As will be appreciated, while only one of the transverse beam structures (18), (20), (22) was illustrated in the sectional view of FIG. 1, a plurality of such structures is provided extending transversely in parallel along the length of the shelter (10). The adjacent transverse beams (18), (22) are separated by, but securely connected to, beam anchor assembly units to be described further below but the location of an adjacent pair of which is shown by arrows (23) in FIG. 2.

Although not visible in FIG. 2, a series of aluminium trays is mounted between each pair of transverse beams (18), (20), (22) as illustrated in FIG. 2 and a section of each of those beams is formed as an inverted T so as to provide ledges upon which the trays are mounted.

The exact configuration of one example of such a tray is discussed further below in relation to FIG. 8.

Insofar as the series of interconnected trays located between each pair of transverse beams (18), (20), (22) is arranged to received a layer of soil, sand or other aggregate, it has been found advantageous to include a geotextile layer upon the trays and prior to the provision of the layer of soil, sand or aggregate. The geotextile material is advantageously clipped, or generally secured in any appropriate manner, to the transverse beams.

Such a geotextile layer (not shown in the drawings) serves to prevent the ingress of sand through the roof structure and into the accommodation offered by the protective shelter, and further serves to enhance the integrity of the soil, sand or aggregate layer should damage be suffered by any one or more of the supporting trays.

FIG. 2 also provides a clear indication of the particular dimensions of the protective structure illustrated in section in FIG. 1.

Figure 3:
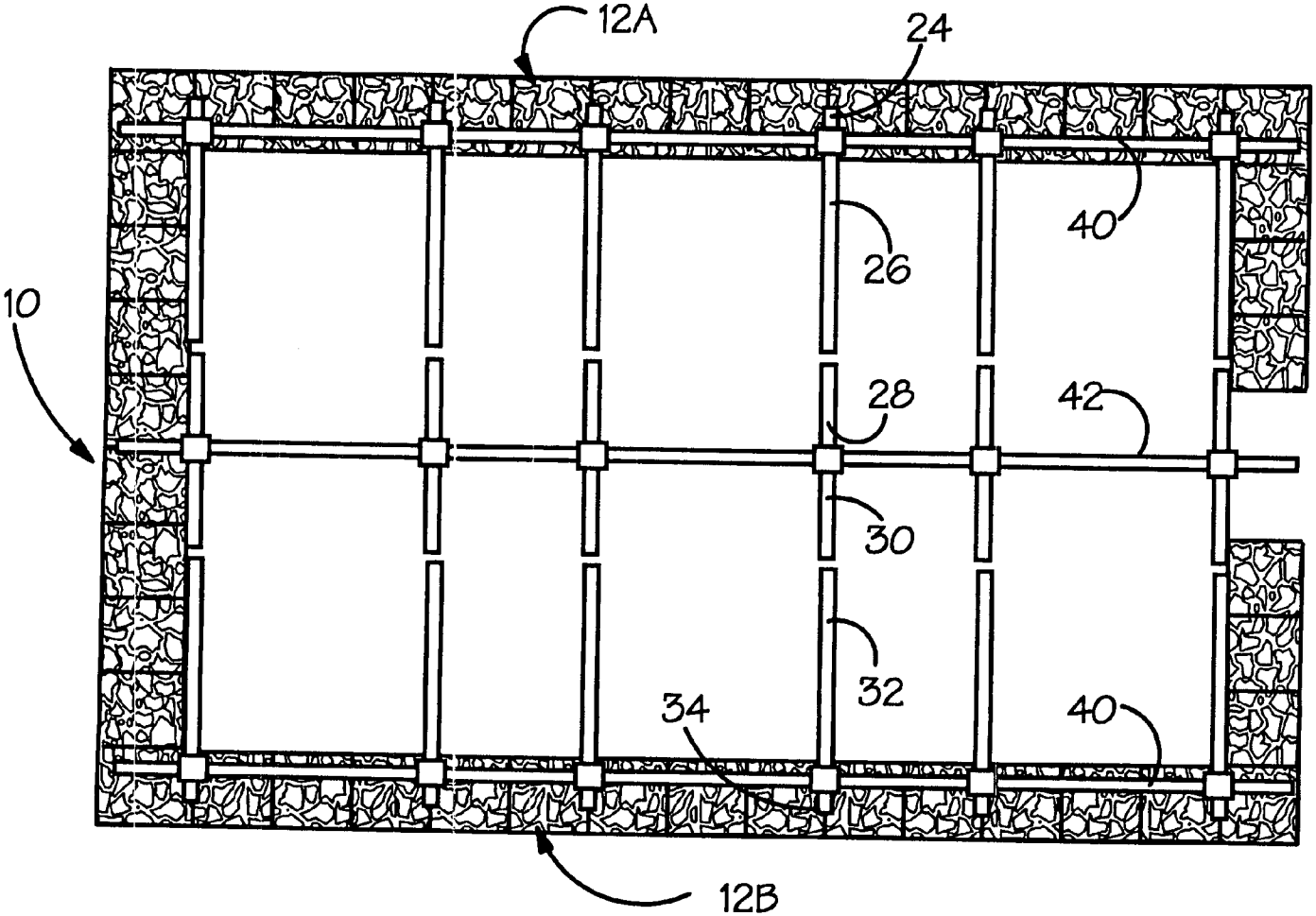
FIG. 3 is a further plan view showing additional detail of the protective shelter of FIG. 1.

Turning now to FIG. 3, a similar plan view to that of FIG. 2 is provided but in this instance only the roof truss structure (24), (26), (28), (30), (32), (34) is illustrated along with the ridge pole (42) and eaves poles (40).

Again, and as with the transverse beam structure (18), (20) and (22) illustrated further in FIG. 2, the roof structure (24), (26), (28), (30), (32), (34) is repeated along the length of the protective shelter (10).

Figure 4:
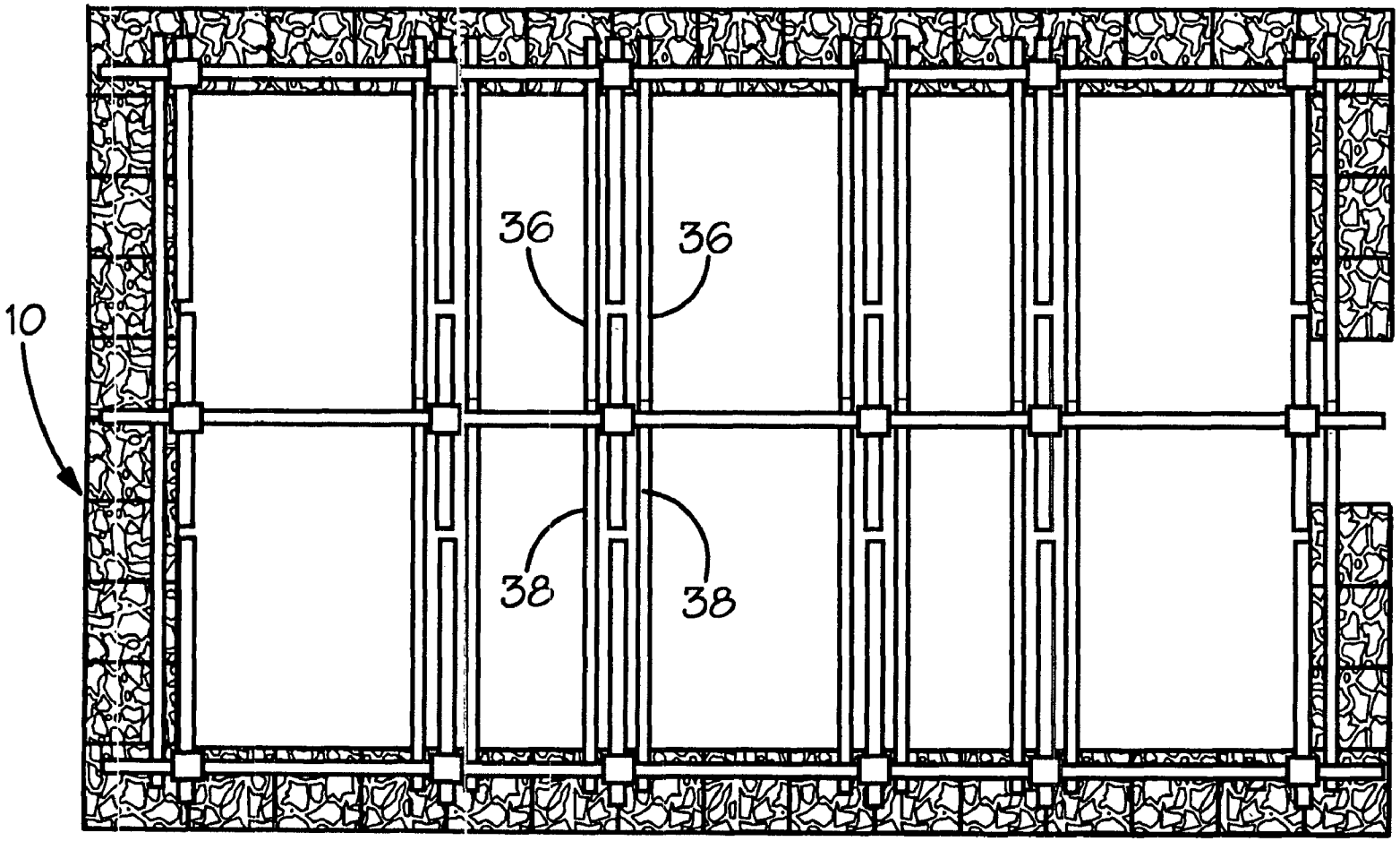
FIG. 4 is a further plan view showing yet additional detail of the shelter of FIG. 1.

With regard to FIG. 4, the roof trusses, ridge pole and eaves poles are again illustrated but now in combination with the rafter poles (36) which, as respective pairs, extend transversely across the roof structure of the protective shelter (10) either side of the series of roof trusses.

Figure 5:
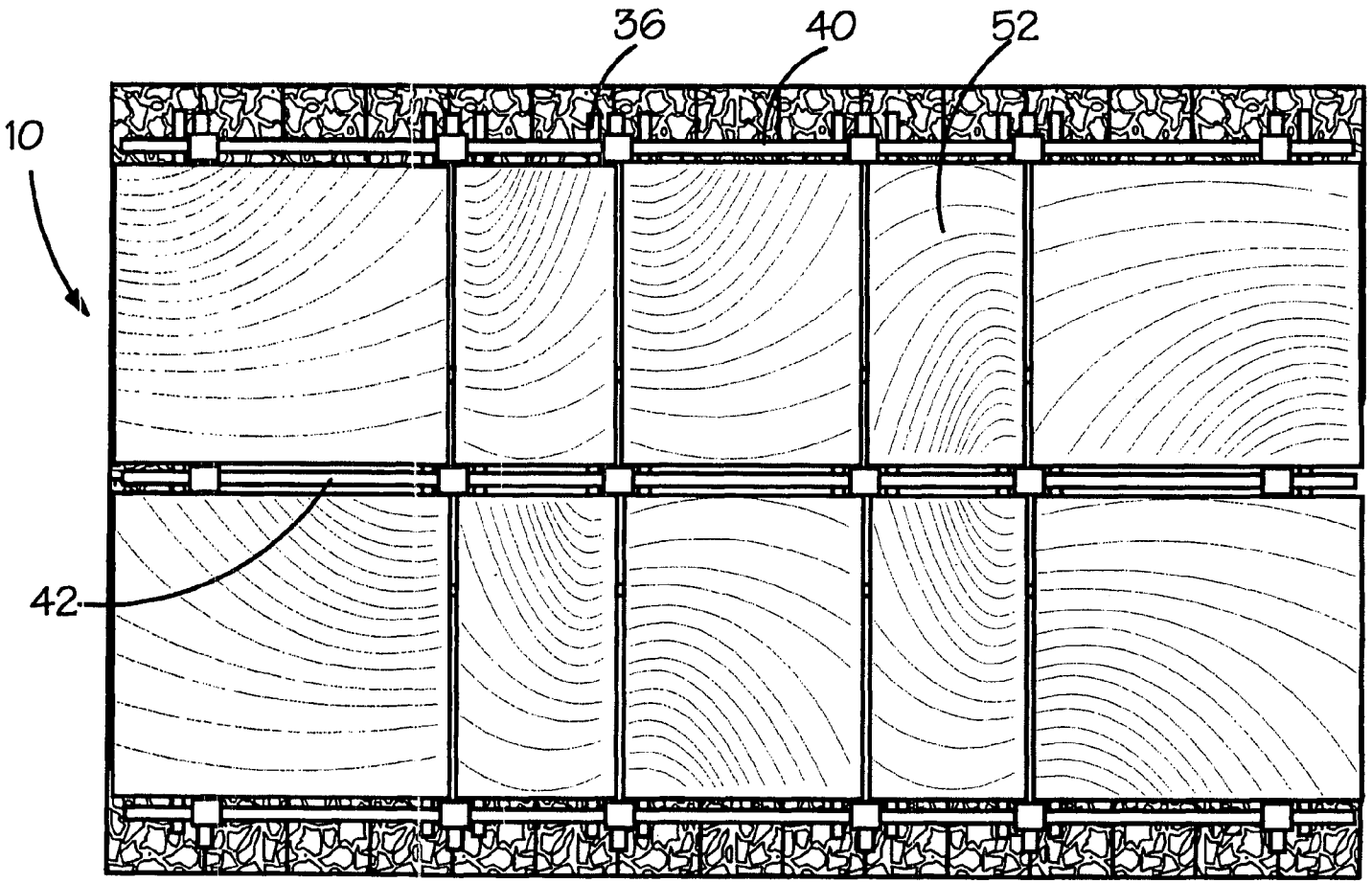
FIG. 5 is the plan view showing further detail of the shelter of FIG. 1 and, in particular, pre-detonation screens laid on the roof structure thereof.

The pre-detonation screen (52) provided by the plywood sheets is illustrated for completeness in FIG. 5 and it should be appreciated that, in the illustrated embodiment, plywood sheets of 19 mm thickness are employed in an attempt to ensure detonation of incoming mortars etc.

Figure 6A:
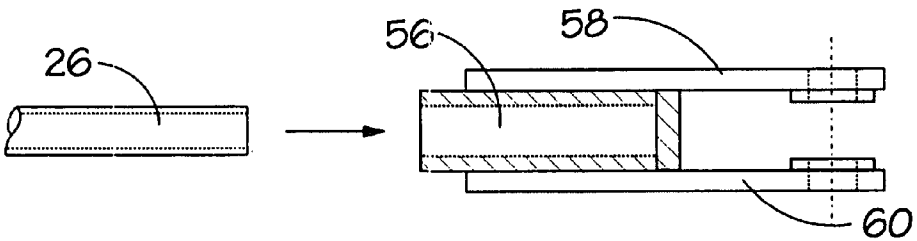
FIGS. 6*a* and 6*b* illustrate connecting members for connecting roof trusses within the roof structure to transverse beams of the roof structure.
Figure 6B:
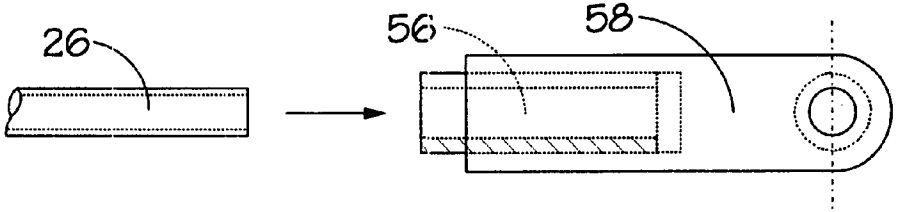

Turning now to FIGS. 6*a* and 6*b*, there are illustrated part sectional and plan views of connector members (not identified in FIG. 1) serving to allow for the connection of the roof trusses to the transverse beam structure (18), (20) and (22).

The embodiment is illustrated through reference to a roof truss (26) such as that illustrated in FIG. 1 and each connector comprises a blind bore (56) arranged for receiving the end of the roof truss (26) therein and wherein the end of the connector remote from the blind bore (56) is provided with two apertured lugs (58), (60) by means of which the connector can be bolted to the transverse beam structure (18), (20), (22) as illustrated in FIG. 1.

Figure 7B:
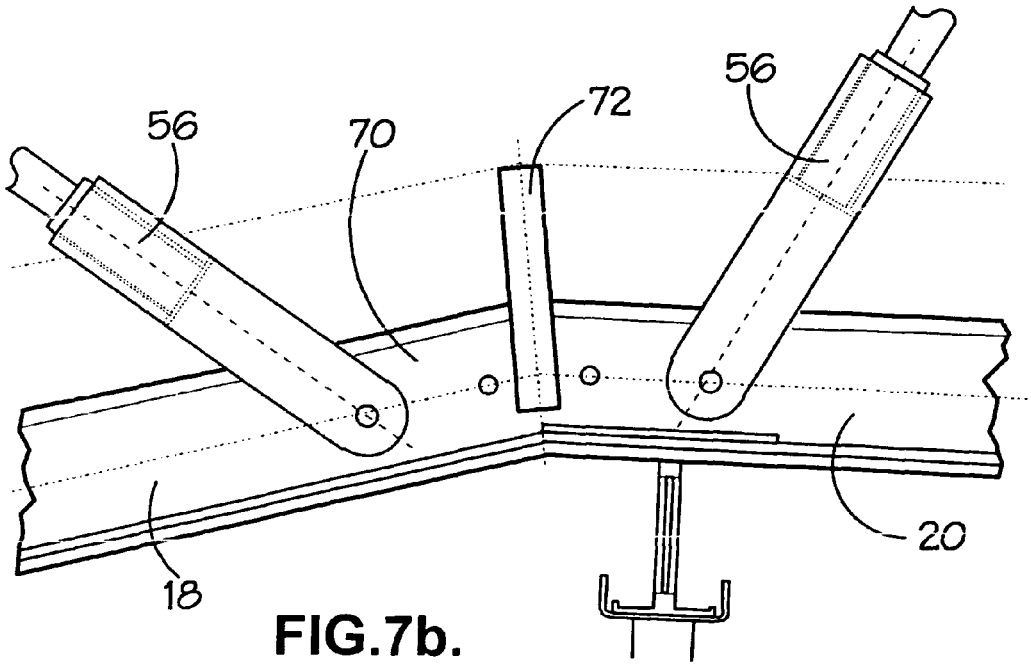
FIG. 7*b* is a side elevational view showing yet further additional detail of the roof trusses and supports of the protective shelter of FIG. 1.
Figure 7:
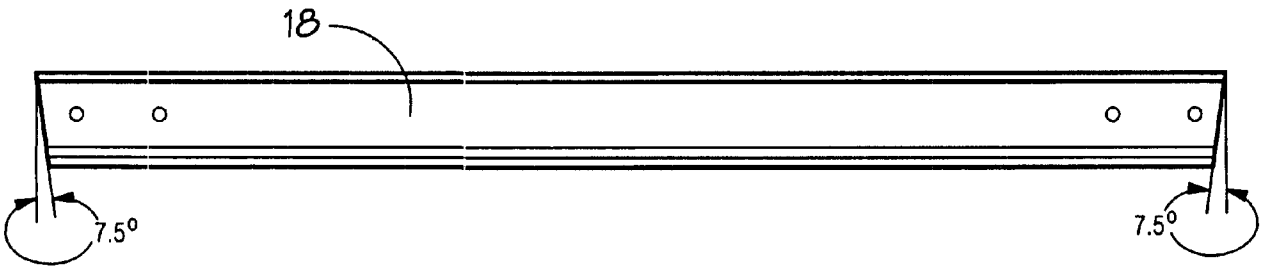
FIG. 7 comprises a side elevational view of a transverse beam of the structure of FIG. 1 and FIG. 7*a* comprises a transverse sectional view of such a beam.

With regard to FIG. 7, there is illustrated a side elevational view of one of the three transverse beams (18), (20), (26) illustrated in FIG. 1.

Figure 7A:
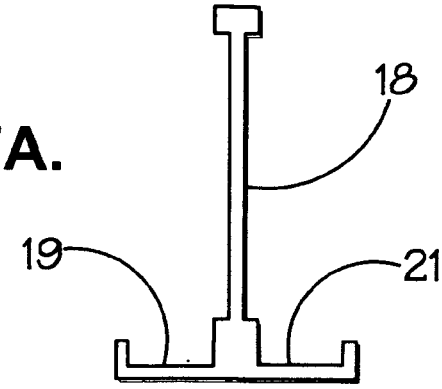

FIG. 7*a* is a transverse sectional view of the beam (18) of FIG. 7 and such as employed as the transverse roof beams (18), (20), (22) illustrated in FIG. 1.

The inverted T section of the roof beam (18) is clearly illustrated in FIG. 7*a* by reference to the laterally extending support portions (19), (21) which are arranged to engage with the lateral extents of each of the sand, earth or aggregate-bearing trays discussed further herein as part of the roof structure.

As will be appreciated, each end face of the transverse beam (18) is of an angled or bevelled configuration and preferably offers an angle of 7.5° to a plane perpendicular to the longitudinal extent of each transverse beam.

Referring again to FIG. 1, it will be appreciated that the previous connected transverse beams (18), (20), (22) serve to form a shallow arch and it is the angled/bevelled ends of each of the beams (18), (20), (22) as illustrated in detail in FIG. 7 that serve to ease the formation of such a shallow arch and in a manner such that each of the beams (18), (20), (22) could be replaced with the other if required.

Thus, a secure structure can be formed in an efficient and speedy manner since positional selection of each of the transverse beams (18), (20), (26) is not required.

Also illustrated within FIG. 7 are the apertures by means of which bolts are received for the series connection, by means of flitch plates or bracket members, of the transverse beams (18), (20), (22) and also for connection of the roof trusses (26), (28), (30), (32) as illustrated in FIG. 1. FIG. 7*b* shows an elevational view of an exemplary flitch plate (70) in more detail, to which the connector members comprising blind bores (56), illustrated in FIGS. 6*a* and 6*b*, and transverse beam structures (18), (20) and (22) are attached. An optional marker bar (72) can be attached to the flitch plate (70) for aligning the flitch plate with the beams.

Figure 8:
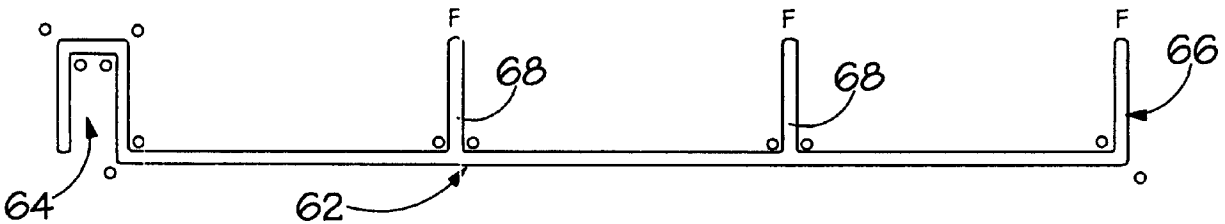
FIG. 8 is a side elevational view of a tray member again forming part of the roof structure illustrated in FIG. 1 but not visible therein.

Turning to FIG. 8, there is illustrated as a side elevational view, one (62) of a plurality of trays which sit in between each of the parallel transverse beam structures (18), (20), (22) as best illustrated in FIG. 2 so as to receive the soil, sand or aggregate thereon and provide the required level of protection against shrapnel, etc.

As will be appreciated, each of the transverse beams (18), (20), (22) has itself an inverted T cross section such that each pair of adjacent beams offers a ledge between which the elongate trays can be mounted.

As with the transverse beams (18), (20), (22) that extend in series across the width of the shelter (10), the trays (62) are arranged to be connected in a series manner extending across the width of the shelter (10), and of course in between the respective parallel transverse beam structures (18), (20), (22) and the respective ends of which are provided with co-operating engagement formations (64), (66).

As will be appreciated from FIG. 8, when two or more of the trays (62) are interconnected, an upstanding engagement formation (66) of one tray is received within a hook formation (64) of its series connected adjacent tray.

Again, such features are particularly advantageous in allowing for a quick, yet secure, formation of a strong but lightweight roof structure for the shelter. The structure of each of the trays can be further enhanced by the inclusion of laterally extending roofs (68) so as to provide bend-resistance to any blast that might occur in the vicinity of the pre-detonation screen, and also to assist in stabilising the mass of earth, sand or aggregate provided thereon.

Figure 9:
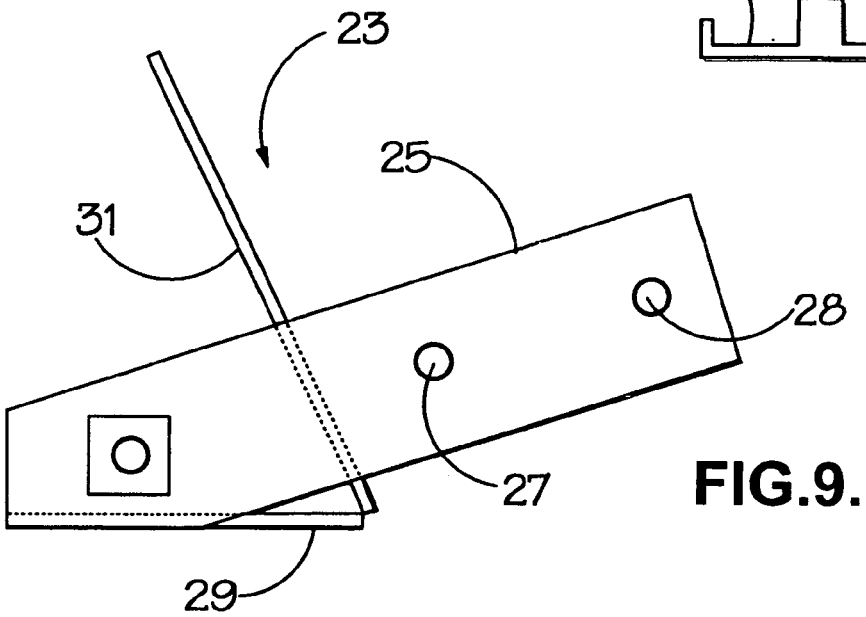
FIG. 9 is a side elevational view of the structure of a roof beam anchor assembly unit according to an embodiment of the present invention.

Turning now to FIG. 9, there is illustrated further detail of one of the roof beam anchor assembly units (23) illustrated earlier in relation to FIG. 1.

Figure 10:
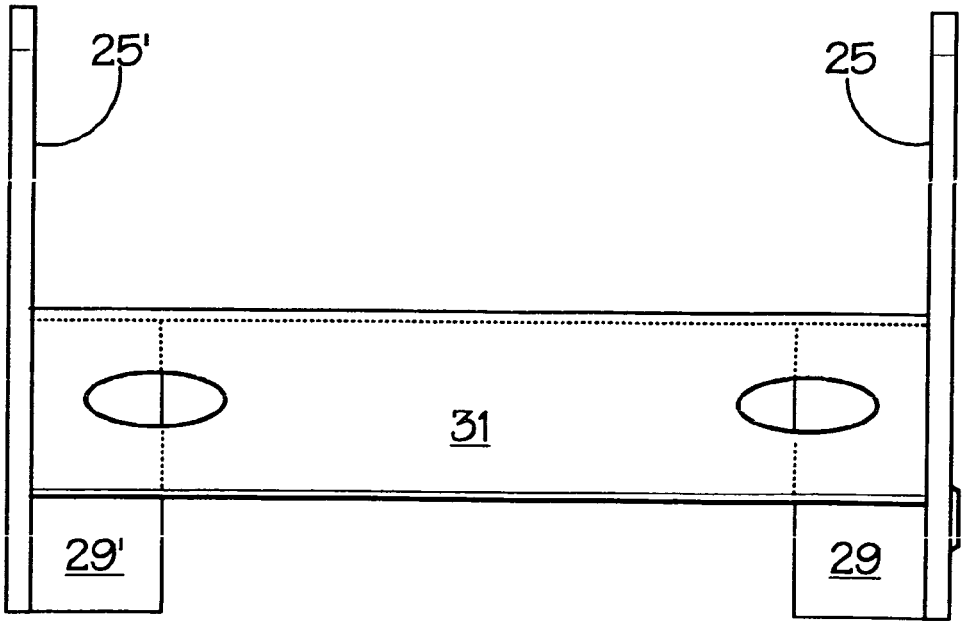
FIG. 10 is an elevational plan view of the roof beam anchor assembly unit of FIG. 9.

FIG. 9 comprises a side elevational view of a roof beam anchor assembly unit (23) such as mounted upon the outer wall (12*a*) of FIG. 1 and which comprises a pair of horizontally extending footing plates of which one (29) is shown in FIG. 9 and from which extends an inclined faceplate (31) extending upwardly at an inclined angle as illustrated in FIG. 9 but also extending as illustrated further with reference to FIG. 10 along the length of the roof beam anchor assembly unit (23).

Welded in a vertical orientation at each end of the roof beam anchor assembly unit (23) is a pair of end plates of which one (25) is illustrated in FIG. 9.

Each end plate (25) includes a pair of aligned apertures (27) arranged for the engagement of the roof beam anchor assembly unit (23) with, for example, the transverse beam (18) as illustrated in FIG. 1 and, in particular, a bolt and flitch plate arrangement associated therewith.

Turning to FIG. 10, the full detail of the illustrated embodiment of the roof beam anchor assembly unit (23) of the present invention is provided by way of a plan view of the unit (23).

Here the vertically extending side wall portions (25) and (25') are clearly shown along with the laterally extending plate (31). The location of each of the respective footing plates (29), (29') is also illustrated.

In use in the arrangement of FIG. 1, it will be appreciated that a plurality of such roof beam anchor assembly units (23) is located in side-by-side manner and with each side plate (25), (25') secured to a transverse roof beam (18). Thus, each of two adjacent roof beam anchor assembly units (23) is connected to, and effectively separated by, a common transverse roof beam (18) such that, along the length of the upper region of the wall (12*a*), there is provided a continuous lintel beam defined by way of the interconnected roof beam anchor assembly units (31) and spaced transverse roof beams (18).

Figure 11:
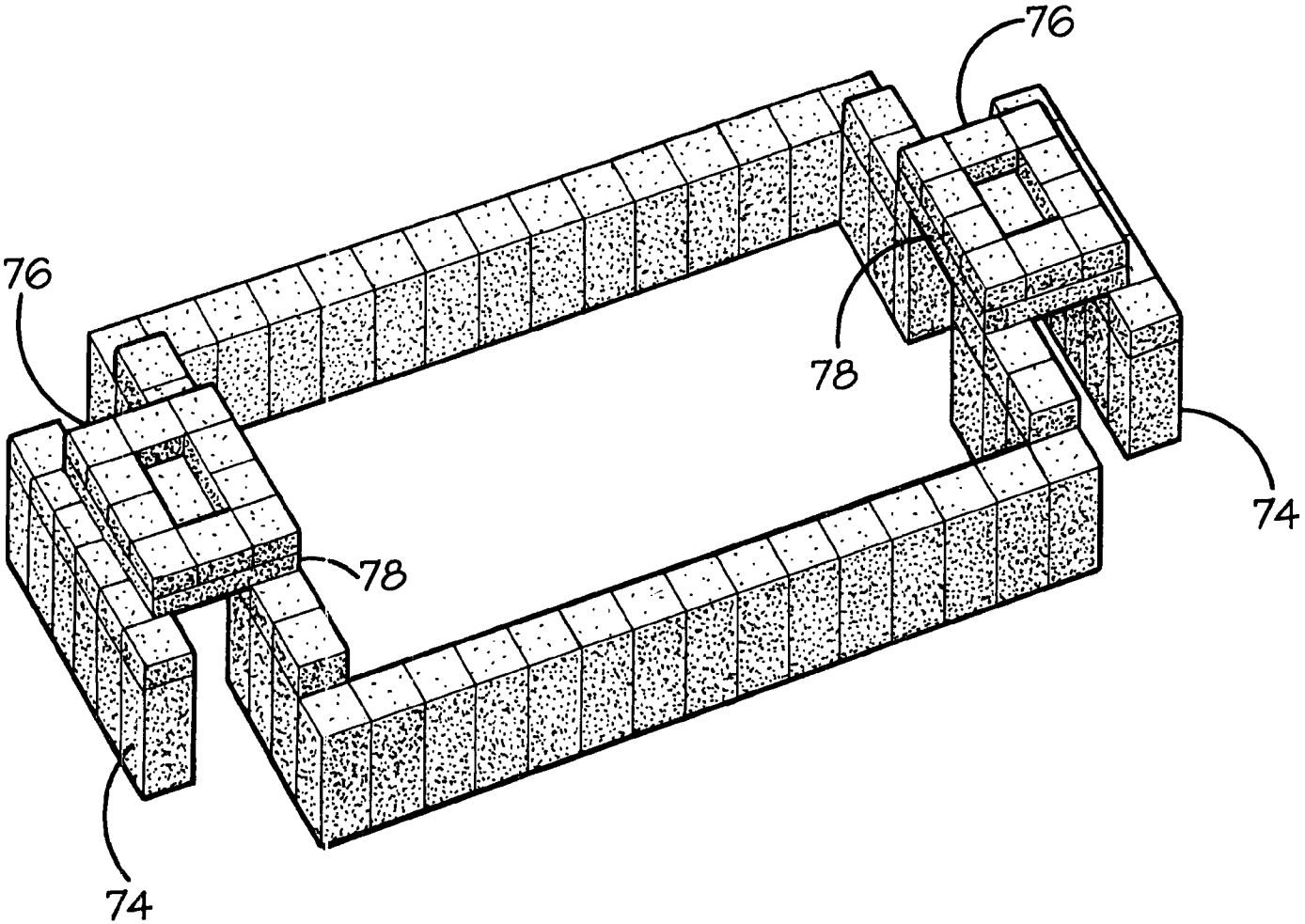
FIG. 11 is a perspective view of the supporting opposite walls and stand-off walls of the protective shelter.
Figure 12:
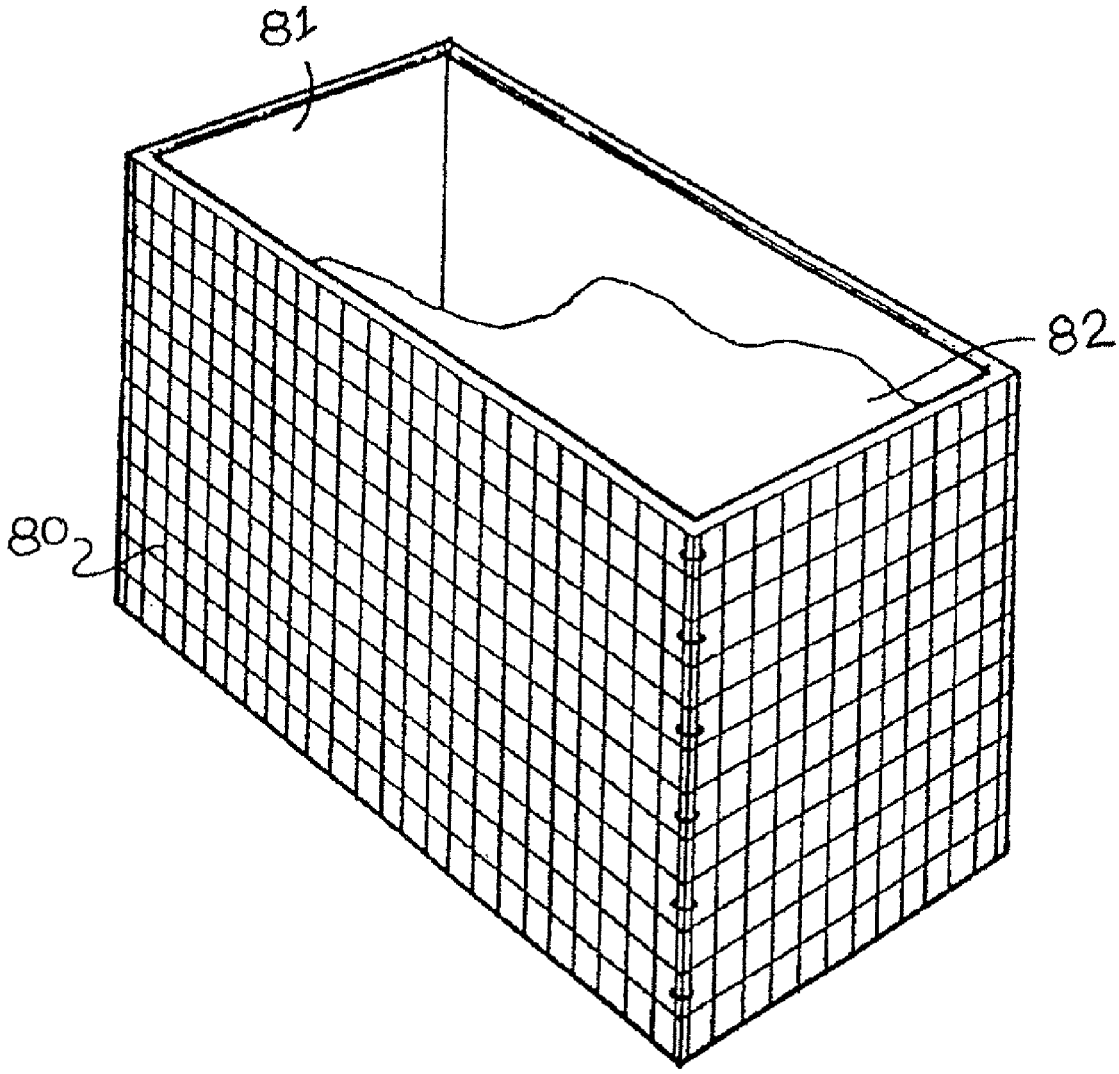
FIG. 12 is a perspective view of a gabion comprising a wall or walls at least partially defined by open work mesh (80), and a lining material (81) lying to the inside of said open work mesh to enable the cage to be filled with a particulate material (82) which would pass through the open work mesh (80) were it not for the presence of the lining material (81).

As illustrated in FIG. 11, the doorway of the protective shelter can find further protection by the provision of one or more stand-off walls (74) located outside the door of the shelter and formed by a line of, for example, seven, bastion units and wherein a porch (76) for such roof structure is provided extending between the shelter and the stand-off wall and which can comprise a crate structure (78) on which are provided smaller gabion units with sand provided thereon.

Then, above the crate-supported gabion units offering the protective porch (76) for such roof structure to the doorway for the protective shelter, an extension of the pre-detonation layer can be provided so as to extend the level of protection offered by the roof structure to the general internal region of the protective shelter, to the region of the shelter's doorway.

It should of course be appreciated that the pre-detonation layer can be formed with any appropriate material, as indeed can the structure for supporting the earth, sand or aggregate layer. However, the alloy envisaged for the illustrated embodiment of the present invention proves particularly advantageous in view of its weight/strength ratio. It will further be appreciated that the features of the protective shelter as described herein can be supplied in unassembled flat-pack form for later assembly.

All publications and patent applications in this specification are herein incorporated by reference as if each individual publication or patent application were specifically and individually indicated to be incorporated by reference in entirety. Although the foregoing invention has been described in some detail by way of illustration and example for purposes of clarity of understanding, it will be readily apparent to those of ordinary skill in the art in light of the teachings of this invention that certain changes and modifications may be made thereto departing from the spirit or scope of the invention described herein.

What is claimed is:

1. A protective shelter comprising:

opposite outer supports; and a roof structure extending between said opposite outer supports, wherein said roof structure comprises a plurality of tray members containing earth, sand or aggregate material and defining an inner skin to provide a first level of protection in said roof structure, wherein said tray members are supported by beams, wherein said beams defining a shallow arch across a width of the shelter such that the internal height of the shelter centrally, and away from said opposite outer supports, is greater than the height of said opposite outer supports.

2. The protective shelter of claim 1, wherein the beams are transverse beams extending between the opposite outer supports.

3. The protective shelter of claim 2, wherein the beams are of identical shape and configuration.

4. The protective shelter of claim 2, wherein end faces of the transverse beams are angled with respect to a plane perpendicular to a longitudinal axis of each of the beams.

5. The protective shelter of claim 4, wherein the angle to said plane is 7.5°.

6. The protective shelter of claim 4, wherein the ends of the transverse beams are received by anchor assemblies mounted on the opposite outer supports.

7. The protective shelter of claim 6, wherein the anchor assemblies are spacing the transverse beams along length of the shelter and are further arranged such that each beam is effectively connected to and sandwiched between adjacent anchor assembly units.

8. The protective shelter of claim 7, wherein the transverse beams connected along the width of the shelter are connected using flitch plates.

9. The protective shelter of claim 2, wherein the transverse beams are further supported by one or more longitudinal beams extending along a length of the shelter.

10. The protective shelter of claim 9, wherein the longitudinal beams are supported by vertical supports.

11. The protective shelter of claim 10, wherein the vertical supports are adjustable props.

12. The protective shelter of claim 2, wherein the ends of the transverse beams are received by anchor assemblies mounted on the opposite outer supports.

13. The protective shelter of claim 12, wherein the anchor assemblies are arranged to space the transverse beams along length of the shelter and that each beam is effectively connected to and sandwiched between adjacent anchor assembly units.

14. The protective shelter of claim 13, wherein the transverse beams connected along the width of the shelter are connected using flitch plates.

15. The protective shelter of claim 1, wherein the roof structure further comprises a screen, spaced above and extending over the tray members, defining an outer skin providing a second level of protection in the roof structure.

16. The protective shelter of claim 15, wherein the space between the tray members and the screen is in the order of 1 meter.

17. The protective shelter of claim 16, wherein the roof structure further includes an outer fabric cover.

18. The protective shelter of claim 15, further comprising roof trusses to support the screen.

19. The protective shelter of claim 18, wherein the roof trusses are respective pairs to be fixed to and extend upwardly from the transverse beams.

20. The protective shelter of claim 19, wherein each roof truss extends upwardly from a position proximate to a respective end of the transverse beams.

21. The protective shelter of claim 19, wherein the respective pairs of roof trusses meet at an apex at an end distal to the proximate end of the transverse beams.

22. The protective shelter of claim 18, wherein each roof truss extends upwardly from a position proximate to a respective end of the transverse beams.

23. The protective shelter of claim 22, wherein the respective pairs of roof trusses meet at an apex at an end distal to the proximate end of the transverse beams.

24. The protective shelter of claim 15, further comprising rafter supports to hold up said screen.

25. The protective shelter of claim 15, wherein said screen is a protective screen.

26. The protective shelter of claim 1, wherein the roof structure further includes an outer fabric cover.

27. The protective shelter of claim 1, wherein the opposite outer supports are walls or gabions.

28. The protective shelter of claim 27, wherein the gabion is a cage structure adapted to be filled with a filling material in order to provide a structural block, said cage structure comprising a wall or walls at least partially defined by open work mesh, and a lining material lying to the inside of said open work mesh to enable the cage to be filled with a particulate material which would pass through the open work mesh were it not for the presence of the lining material.

29. The protective shelter of claim 1, wherein said beams are of identical shape and configuration.

* * * * *